US010893761B2

(12) United States Patent
Lam

(10) Patent No.: US 10,893,761 B2
(45) Date of Patent: Jan. 19, 2021

(54) CRAFT PICTURE MEDIA WITH INTEGRAL FRAME

(71) Applicant: Hok Ming Lam, Duarte, CA (US)

(72) Inventor: Hok Ming Lam, Duarte, CA (US)

( * ) Notice: Subject to any disclaimer, the term of this patent is extended or adjusted under 35 U.S.C. 154(b) by 0 days.

(21) Appl. No.: 16/336,897

(22) PCT Filed: Sep. 25, 2017

(86) PCT No.: PCT/US2017/053344

§ 371 (c)(1),
(2) Date: Mar. 26, 2019

(87) PCT Pub. No.: WO2018/058081

PCT Pub. Date: Mar. 29, 2018

(65) Prior Publication Data

US 2019/0246817 A1 Aug. 15, 2019

Related U.S. Application Data

(60) Provisional application No. 62/399,937, filed on Sep. 26, 2016.

(51) Int. Cl.
*A47G 1/06* (2006.01)
*B44D 3/18* (2006.01)
(Continued)

(52) U.S. Cl.
CPC ..... *A47G 1/065* (2013.01); *A47G 1/0633* (2013.01); *A47G 1/08* (2013.01); *A47G 1/141* (2013.01); *A47G 1/17* (2013.01); *B31D 5/04* (2013.01); *B44D 3/18* (2013.01); *A47G 2001/0672* (2013.01); *A47G 2001/0677* (2013.01)

(58) Field of Classification Search
CPC ..... A47G 1/0633; A47G 1/141; A47G 1/10; B44D 3/18
See application file for complete search history.

(56) References Cited

U.S. PATENT DOCUMENTS 849,111 A * 4/1907 Fairchild ..... A47G 1/0633 40/786
1,262,508 A * 4/1918 Kaufman ..... A47G 1/0633 40/789

(Continued)

FOREIGN PATENT DOCUMENTS

| | | |
|---|---|---|
| FR | 2516452 A1 | 5/1983 |
| JP | 3206131 U | 9/2016 |
| WO | 98/34522 A1 | 8/1998 |

OTHER PUBLICATIONS

US 5,819,447 A, 10/1998, Yamawaki (withdrawn)

(Continued)

*Primary Examiner* — Gary C Hoge
(74) *Attorney, Agent, or Firm* — Danton K. Mak; Leech Tishman Fuscaldo & Lampl

(57) ABSTRACT

Craft pictorial media that is easily folded to form a frame structure includes a sheet of relatively stiff paper having a rectangular main region and respective edge portions extending outwardly from each side and end of the main region, the edge portions being defined by fold lines that are marked and/or embossed, or carved in case the sheet of material is extra thick. Corner reinforcements can also be included.

12 Claims, 11 Drawing Sheets

(51) Int. Cl.

| | |
|---|---|
| ***A47G 1/14*** | (2006.01) |
| ***A47G 1/17*** | (2006.01) |
| ***B31D 5/04*** | (2017.01) |
| ***A47G 1/08*** | (2006.01) |

(56) References Cited

U.S. PATENT DOCUMENTS 2,737,742 A 3/1956 Leigh
4,136,470 A * 1/1979 Barz ..... A47G 1/10 40/782
4,348,127 A * 9/1982 Hays, Jr. ..... A47G 1/10 40/782
9,358,830 B1 * 6/2016 McLaughlin ..... B44D 3/18
2003/0121194 A1 7/2003 Rappaport
2005/0016047 A1 * 1/2005 Yamagishi ..... A47G 1/0611 40/782
2005/0102879 A1 * 5/2005 Houssian ..... A47G 1/10 40/785
2010/0043269 A1 * 2/2010 Gipson ..... A47G 1/10 40/783
2010/0242400 A1 * 9/2010 Sawyers ..... A47G 1/10 52/656.9
2012/0267062 A1 * 10/2012 Ainge ..... B44D 3/18 160/371
2013/0205631 A1 * 8/2013 Steichen ..... A47G 1/0633 40/743
2013/0227868 A1 * 9/2013 Edmondson ..... A47G 1/0633 40/743
2014/0314971 A1 * 10/2014 Domanski ..... B41M 5/508 428/32.18
2014/0318722 A1 * 10/2014 Ridless ..... B44C 5/02 160/371
2014/0338242 A1 * 11/2014 Zhou ..... B32B 3/28 40/774
2014/0363592 A1 * 12/2014 Zhou ..... A47G 1/0633 428/32.22
2016/0023366 A1 * 1/2016 Kane ..... B26D 3/085 427/256
2016/0143461 A1 * 5/2016 Millman ..... B44D 3/18 40/786
2016/0227945 A1 * 8/2016 Wong ..... B31D 5/04
2016/0296044 A1 * 10/2016 Millman ..... A47G 1/0633
2016/0297236 A1 * 10/2016 Edgerton-Ball ..... B44D 3/18
2017/0172325 A1 * 6/2017 Greene ..... A47G 1/0633
2018/0213950 A1 * 8/2018 Millman ..... A47G 1/16
2019/0210403 A1 * 7/2019 Fernandez Munizaga ..... B44D 3/185

OTHER PUBLICATIONS

USPTO, International Search Report and Written Opinion issued in parent International Patent Application No. PCT/US2017/053344, dated Dec. 1, 2017 (9 pages).

* cited by examiner (Small Frame Closed)

(Small Frame Opened)

(Medium Frame Open)

10'

(Medium Frame Closed)

(Large Frame Closed)

10"

CRAFT PICTURE MEDIA WITH INTEGRAL FRAME

CROSS REFERENCE TO RELATED APPLICATIONS

This application is a United States national phase entry of International Patent Application No. PCT/US2017/053344 titled "Craft Picture Media With Integral Frame" filed on Sep. 25, 2017, which claims the benefit of U.S. Provisional Patent Application No. 62/399,937, filed on Sep. 26, 2016, the contents of which are incorporated herein by reference in their entirety.

BACKGROUND

The present invention relates to artwork, and more particularly to drawings, paintings, printed images and the like, intended for display. Commonly, work done on rigid media is displayed mounted in a conventional picture frame that can be hung on a wall surface using a wire or other fixture(s). Flexible media such as paper is typically sandwiched between a rigid backing and glass. Canvas media is normally mounted on a support frame, the finished work being assembled to the back of a display frame.

In some situations, such as art exercises in school settings, it is desired to provide for artwork display at very low cost. Often, however, cost dictates simply providing the artist with only a sheet of paper. Consequently, many of those never get displayed satisfactorily.

Thus there is a need for a way to satisfactorily display pictorial artwork at very low cost.

SUMMARY

The present invention meets this need by providing craft pictorial media that is easily folded to form a frame structure. In one aspect of the invention a sheet of foldable media is provided having means for defining a generally rectangular perimeter outline and locations of folds to be made, for producing a reinforcing frame integrally with the media. The fold locations are on lines spaced inwardly from sides and ends of the perimeter outline, to define respective inside edges, back edges, and outside edges of a combined main media portion and frame portion. An additional fold location between that for the inside edge and the perimeter outline can define a tab to be tucked against the main media portion of the media between the inside edge and the outside edge.

Preferably the craft pictorial media has the fold locations embossed therein for facilitating clean (straight and accurately located) folding. Additionally, or alternatively, the fold locations can be drawn, such as by printing.

Preferably the craft pictorial media includes means for defining one or more intersecting slit pairs suitable for receiving a hanger member such as a nail head. The slit pairs can be located on a back edge portion of the media, being used when artwork is to be applied opposite the frame portion, and another slit pair can be located symmetrically on an opposite one of the back edge portions. Alternatively, or additionally, slit pairs can be located on the main portion of the media between the inside edge and the outside edge, being used when artwork is to be applied oppositely, within an area defined by the inside edges of the frame portion.

The craft pictorial media can further include L-shaped corner reinforcement members to be enclosed within corner portions of the frame portion. The reinforcement members preferably have a thickness that closely fits between the main portion and the back. The reinforcement members can be formed of a suitable plastic, and/or a stacked plurality of the media material. Further, an open rectangular member, whether unitary solid or hollow, or including a stacked plurality of thinner members, can reinforce all four corners of the frame.

In another aspect of the present invention, a method for producing craft pictorial media includes the steps of (a) providing a sheet of foldable media material having a flat main surface and fold line indicia formed thereon for outside, back, and inside frame edges; and (b) folding at each of the fold lines on four sides, extremities of the inside edges proximately meeting the main surface. The method can include the further step of drawing on one side of the flat surface. The method can include the further step of affixing a magnetic strip or tape for wall hanging.

In another aspect, the method includes the steps of (a) providing a sheet of foldable media material having a flat main portion and fold lines formed thereon;
(b) providing a plurality of L-shaped corner reinforcements;
(c) rolling a first side portion of the frame, by folding at each of the fold lines, edge extremities of the inside edges proximately meeting the flat main portion;
(d) inserting ones of the L-shaped corner reinforcing members into opposite ends of the first frame side;
(e) rolling opposite second and third side portions of the frame;
(f) inserting additional ones of the corner reinforcements into open ends of the second and third frame sides; and
(g) rolling the final side.

The method can include the further steps of: (a) punching a pair of holes; and (b) inserting a hanging rope, cord, or wire. The step of providing the corner reinforcements can include defining the reinforcements together with the template, the method further comprising the steps of (a) detaching the corner reinforcements and (b) stacking the reinforcements for filling open ends of respective frame sides.

DRAWINGS

These and other features, aspects, and advantages of the present invention will become better understood with reference to the following description, appended claims, and accompanying drawings, where:

DESCRIPTION

Figure 1:
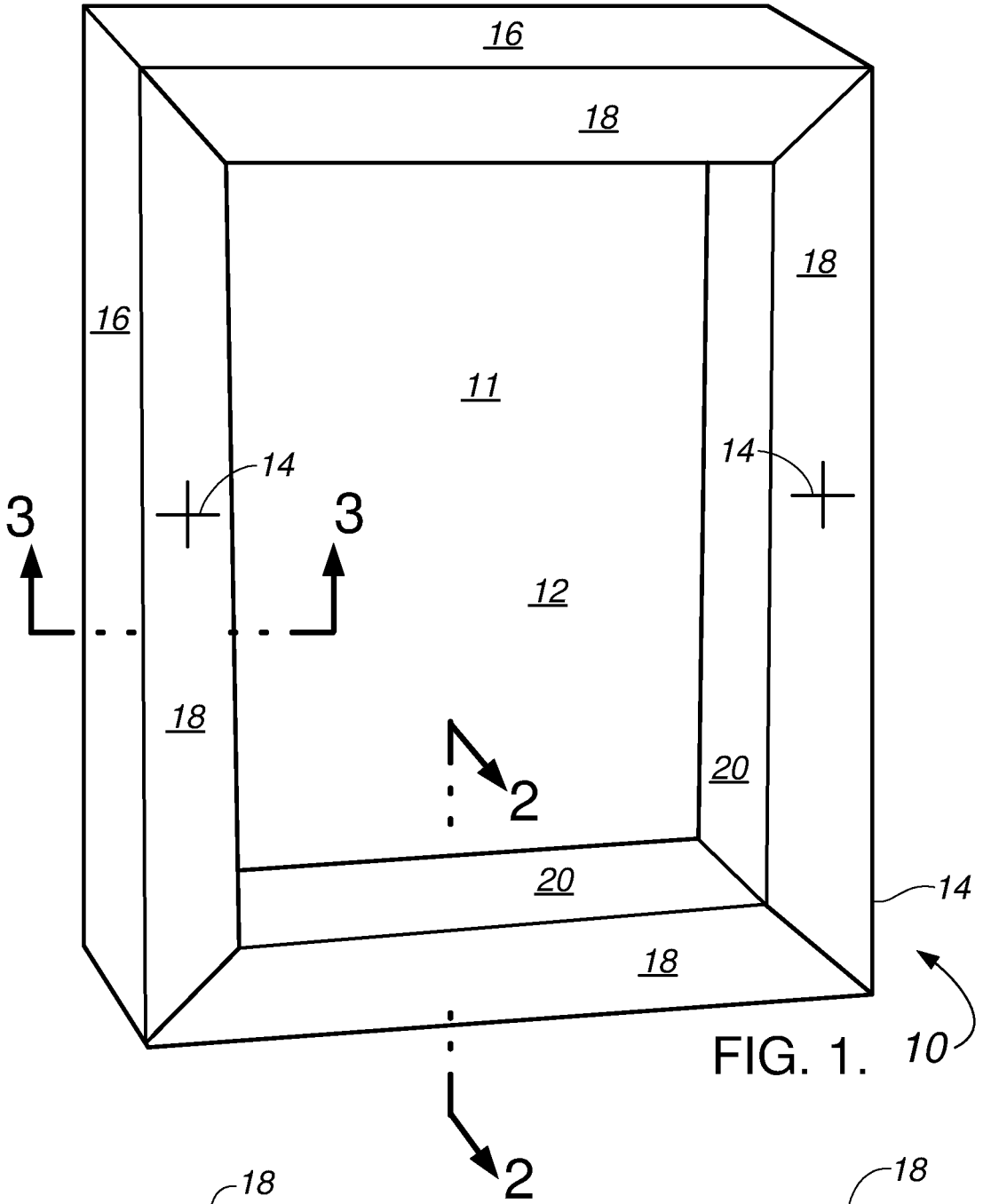
FIG. 1 is an elevational perspective view of craft pictorial media that is formed to include frame structure according to the present invention.
Figure 3:
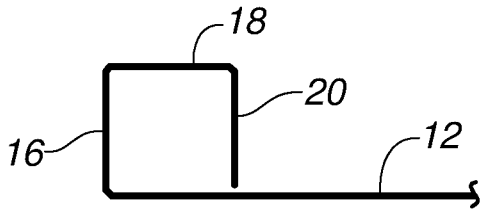
FIG. 3 is a fragmentary side sectional elevational view of the craft media of FIG. 1 on line 3-3 therein.
Figure 2:
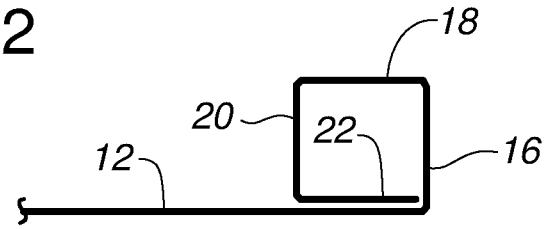
FIG. 2 is a fragmentary side sectional elevational view of the craft media of FIG. 1 on line 2-2 therein.
Figure 4:
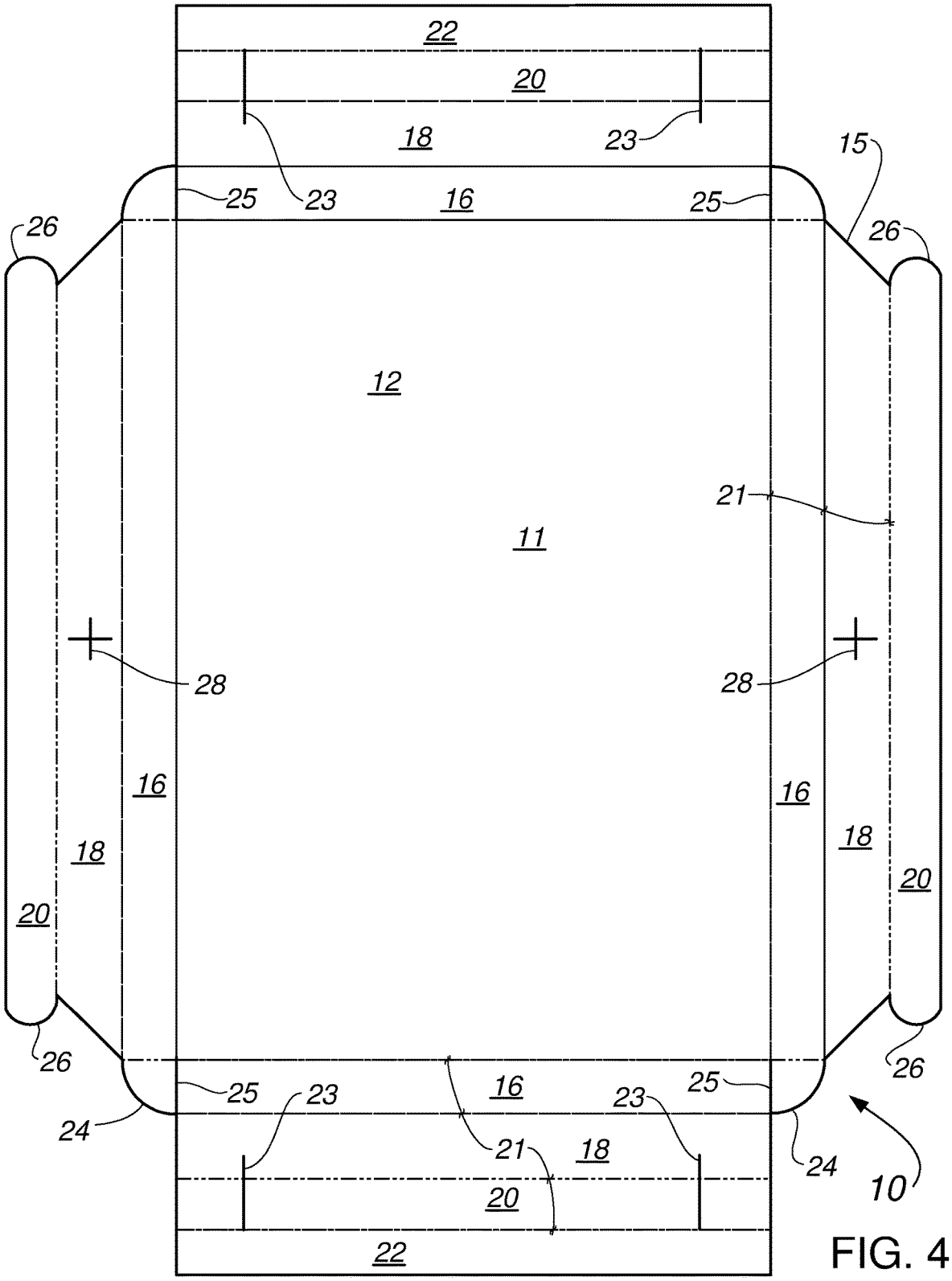
FIG. 4 is a flat pattern layout of the craft media of FIG. 1.

The present invention is directed to craft pictorial media that is easily folded to form a frame structure, and that is particularly inexpensive to provide. With reference to FIGS. 1-4 of the drawings, exemplary craft media 10 according to the present invention includes substrate 11 having a main media portion 12 and a frame portion 14 that is integrally formed of outer portions of the same substrate material as the main portion 12, within a perimeter outline 15. The frame portion 14 includes side edges 16, back edges 18, inside edges 20 and, optionally, tabs 22. FIG. 4 shows the tabs 22 present on opposite ends, but absent on opposite sides. Respective fold lines 21 extend between the side edges 16, back edges 18, inside edges 20 and, if present, the tabs 22.

A gusset 24 is formed at each corner of the main media portion 12, primarily for closing potential gaps between adjacent ones of the frame side edges 16. Each of the gussets 24 extends from one frame side edge 16, being separable from an adjacent side edge 16 by a gusset slit 25. To that end, each gusset 24 is to be folded inside of its adjacent frame portion. Opposite ends of the inside edges 20 forming opposite sides of the frame portion 14 are extended to form arcuate tab extensions 26. The tab extensions 26 are to be inserted into corresponding tab slits 23 that are formed in the back edges 18 and the inside edges 20 of opposite end portions of the frame portion, for enhancing the structural integrity of the completed craft media. These slits can have triangular enlargements for facilitating insertion of the tab extensions 26.

Intersecting slit pairs 28 are formed at midpoints of opposite back edges 18 for receiving nail heads on which the craft media can be hung. It will be understood that such intersecting slit pairs can be provided on any or all of the back edges 18. Further, when it is desired that the frame portion 14 (edges 16, 18, 20) face outwardly, such intersecting slit pairs can be formed in the main media portion 12, preferably proximate outer margins thereof so that nail heads present would not be visible.

Figure 5:
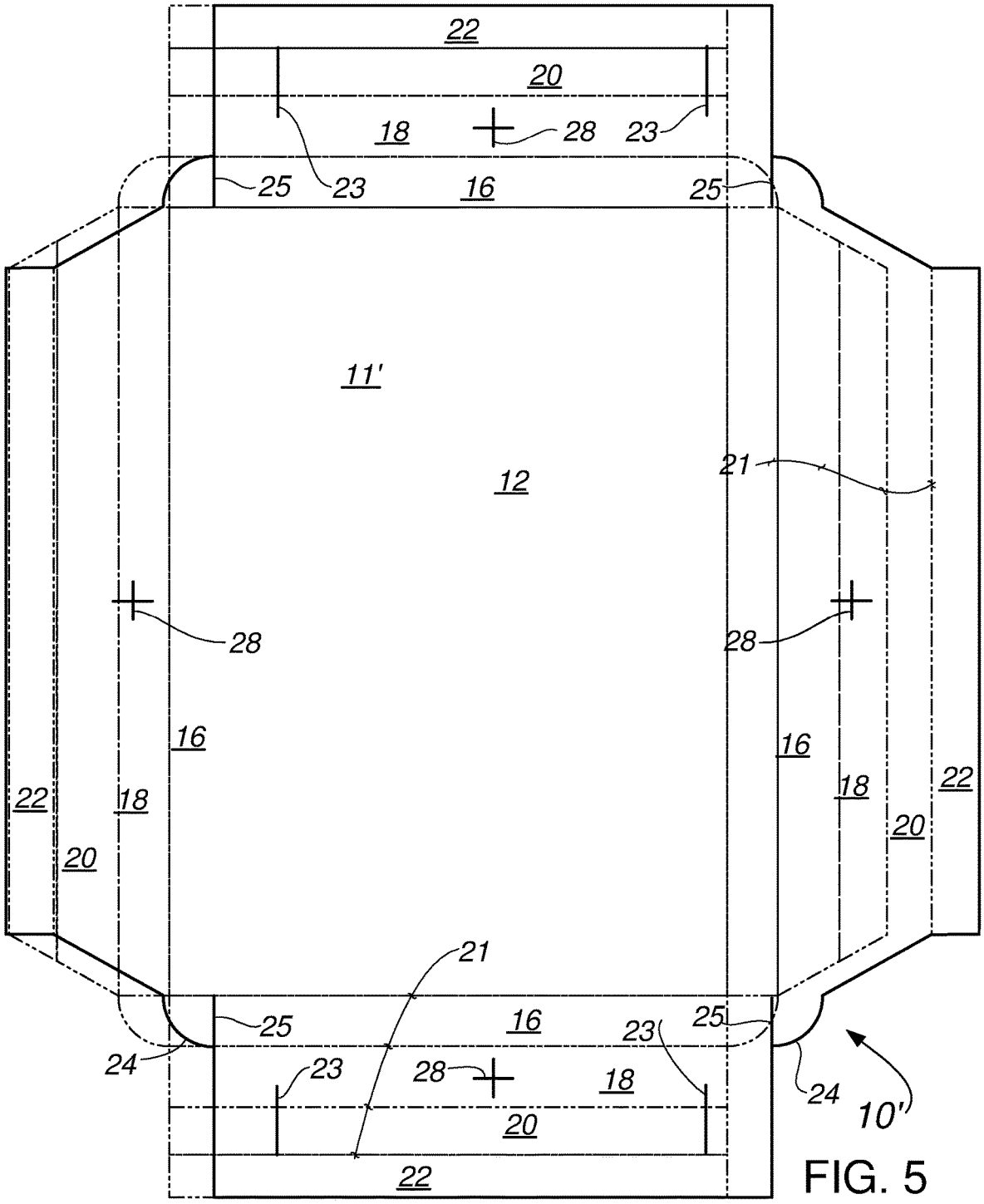
FIG. 5 is a flat pattern layout showing an alternative configuration of the craft media of FIG. 1.
Figure 6:
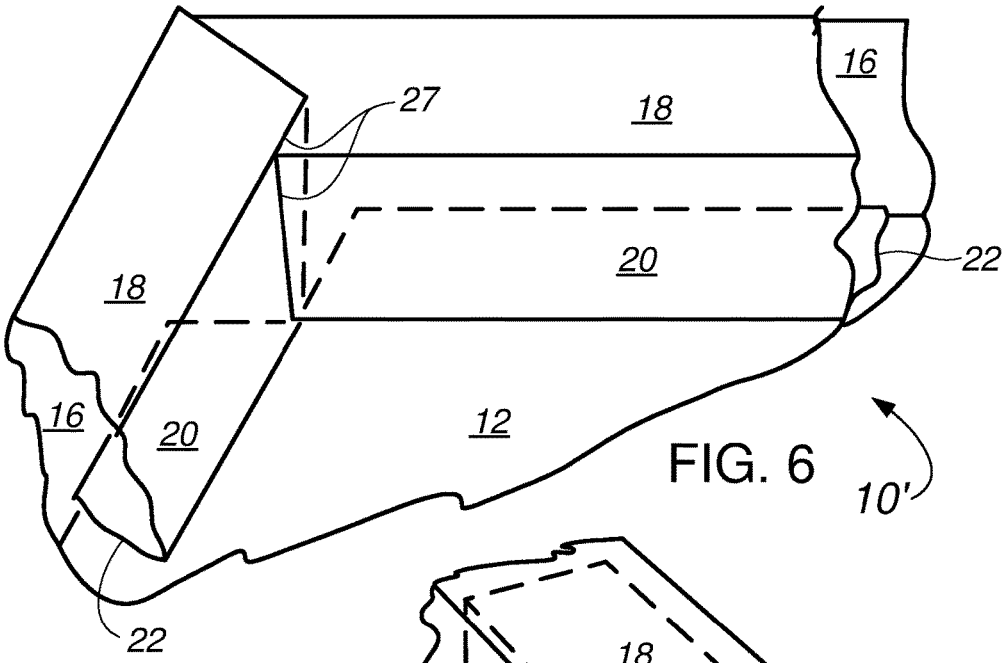
FIG. 6 is a fragmentary perspective view of a portion of the craft media of FIG. 5.

With further reference to FIGS. 5 and 6, an alternative configuration of the craft pictorial media, designated 10', is intended for somewhat larger size and stiffer media, designated substrate 11'. The pictorial media 10' has counterparts of the main portion 12, and the frame portion 14, including the outside edges 16, the back edges 18, the inside edges 20, the tabs 22, and the gussets 24. In this exemplary configuration there are four counterparts of the tabs 22, on both sides and both ends of the frame portion 14. Also, counterparts of the intersecting slit pairs 28 are formed on each of the back edges 18. Further, at opposite sides of the frame portion, opposite ends of each inside edge 20 are beveled in combination with the back edges 18, whereas the configuration of FIGS. 1-4 has only the side back edges beveled. This configuration does not include the tab extensions 26 of the configuration of FIGS. 1-4, the alternative bevel configuration of the side back and inside edges 18 and 20 permitting similar insertion of opposite ends of the side inside edges 20 into the corresponding ones of the tab slits 23, described above, indicated as 27 in FIG. 6.

Figure 7:
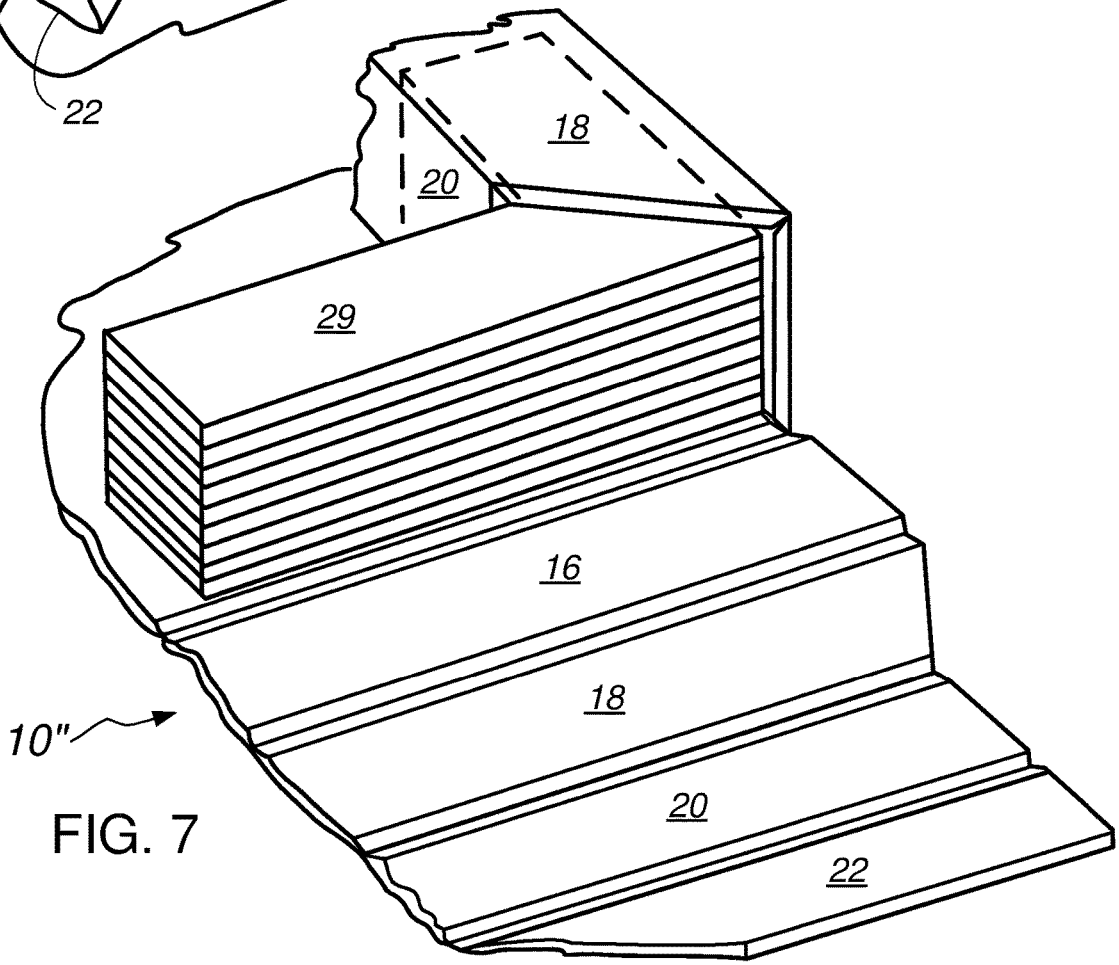
FIG. 7 is a fragmentary perspective view showing a portion of another alternative configuration of the craft media of FIG. 1, partially completed.
Figure 8:
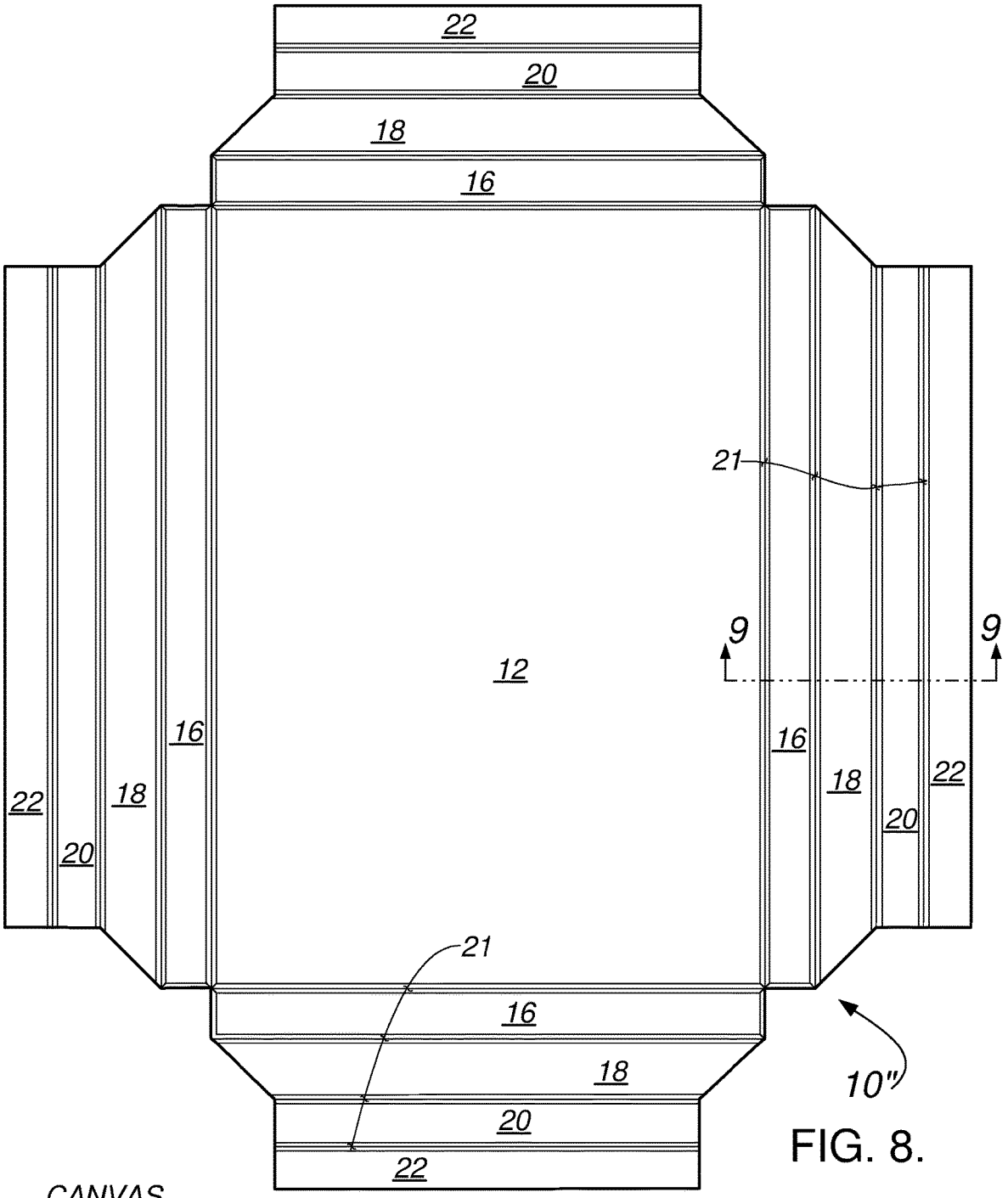
FIG. 8 is a flat pattern layout of the craft media of FIG. 7.
Figure 9:
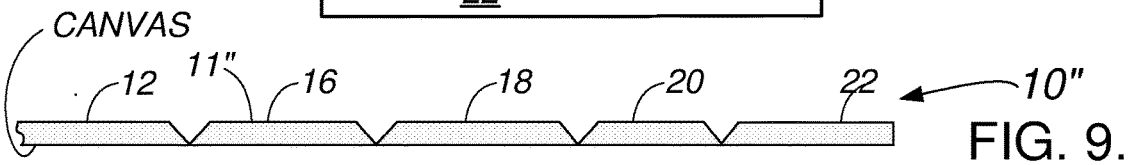
FIG. 9 is a fragmentary side sectional elevational view of the craft media of FIG. 7 on line 9-9 therein.

With further reference to FIGS. 7-9, another alternative configuration of the craft media, designated 10", and intended for even larger size and stiffer media, designated substrate 11", has counterparts of the main portion 12, and the frame portion 14, including the outside edges 16, the back edges 18, the inside edges 20, the tabs 22, and the gussets 24. In this exemplary configuration there are again four counterparts of the tabs 22, but no counterparts of the intersecting slit pairs 28 in that the intended material would not pass nail heads through mere slits. Also, the gusset slits 25 (or slots) are not present in that different corner reinforcements are included as described herein. More particularly, respective L-shaped corner reinforcement members 29 are assembled into the frame portion 14 at each corner thereof as shown in FIG. 7. The reinforcement members 29 can be formed of a stacked plurality of members made of the same material as the craft media itself (and having the same thickness), or they can be integrally formed, such as by molding or cutting from suitably thick material. A suitable material for use in the configuration of FIGS. 7-9 is a lamination of canvas and a rigid material such as fiberboard. The fiberboard is beveled at the fold lines 21 as shown in the drawings.

Figure 10:
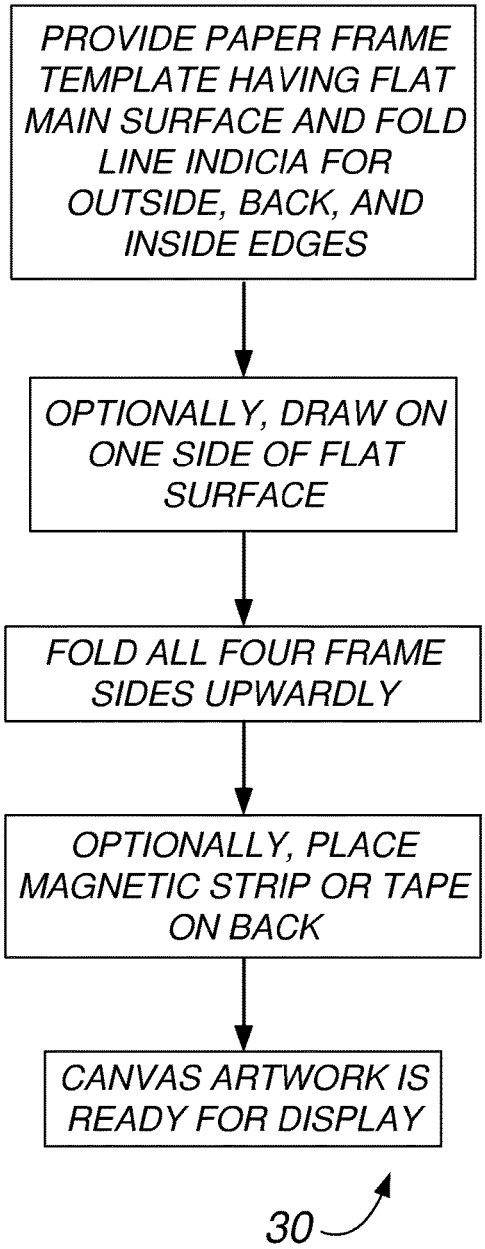
FIG. 10 is a flow chart showing steps to form a canvas drawing frame.

With further reference to FIG. 10, a method 30 for producing the craft pictorial media 10 of FIGS. 1-4 as canvas artwork includes the steps of:

1. Providing a paper and/or canvas frame template having a flat main surface and fold line indications for outside edges, back edges, and inside edges;
2. Optionally, providing artwork on one side of the main surface;
3. Folding all four frame sides, by folding at each of the fold line indications until the inside edges proximately meet the main surface; and
4. Optionally, attaching a magnetic strip or tape,
5. Whereby the pictorial media is ready for display.

The frame template can further be provided with fold line indications for tabs adjacent the inside edges, the folding step further resulting in the tabs being in facing relation with the main surface opposite the back edges.

Figure 11:
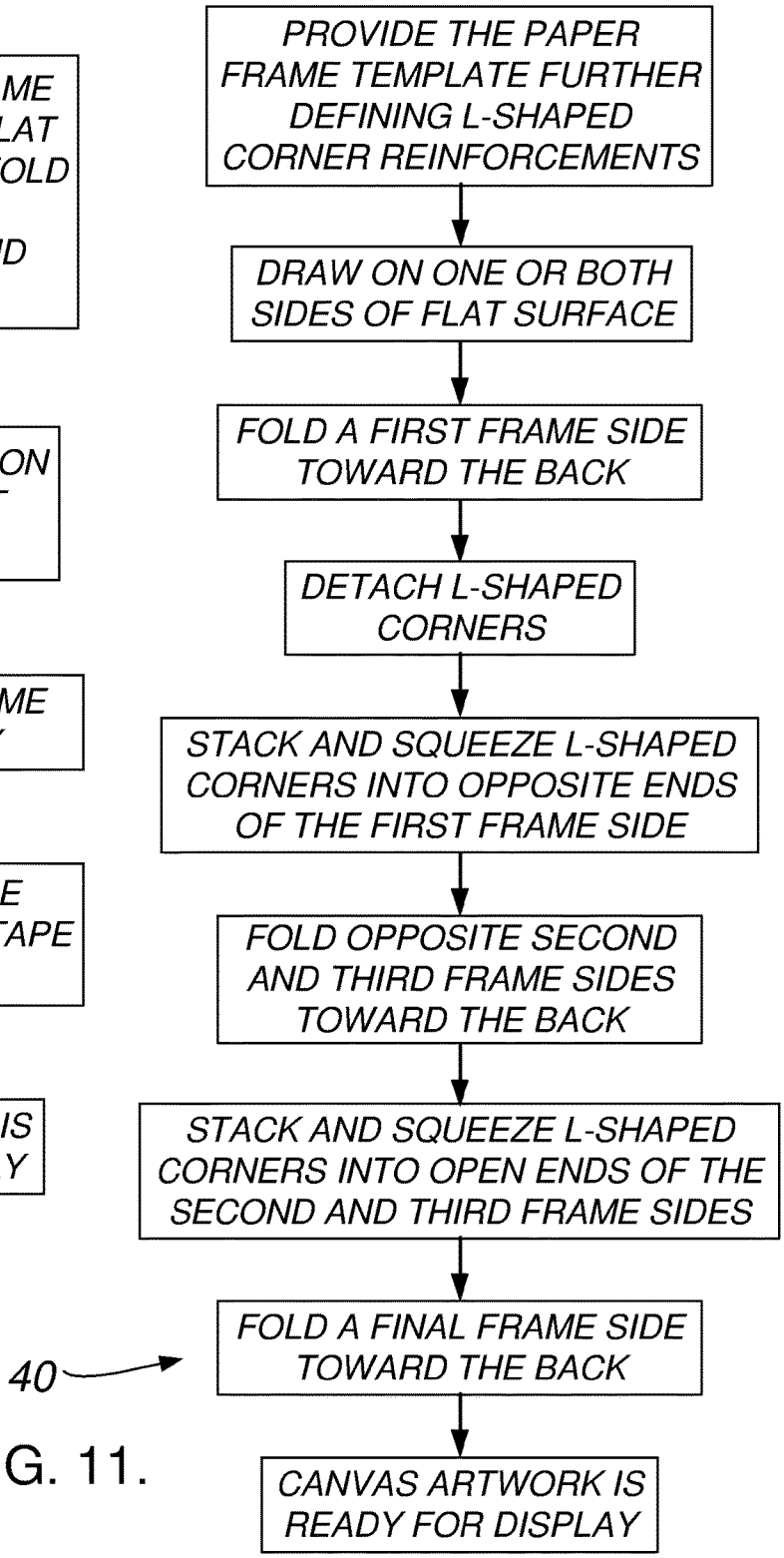
FIG. 11 is a flow chart showing steps to form a paperboard canvas frame having L-shaped corner reinforcements.

With further reference to FIG. 11, a method 40 for producing the alternative configuration 10" of FIGS. 7-9 includes the steps of:

1. Providing the frame template further defining L-shaped corner reinforcements;
2. Optionally, providing artwork on one or both sides of the main surface;
3. Folding a first frame side, until the inside edges proximately meet the main surface;
4. Detaching the L-shaped corners;
5. Stacking and squeezing the L-shaped corners into opposite ends of the first frame side;
6. Folding opposite second and third frame sides until the inside edges proximately meet the main surface;
7. Stacking and squeezing the L-shaped corners into open ends of the second and third frame sides;

8. Folding a final frame side, until the inside edge proximately meets the main surface;
9. Whereby the canvas artwork is ready for display.

The method can further include the step of inserting a hanging rope, cord, or wire, after first punching a pair of holes.

Figure 12:
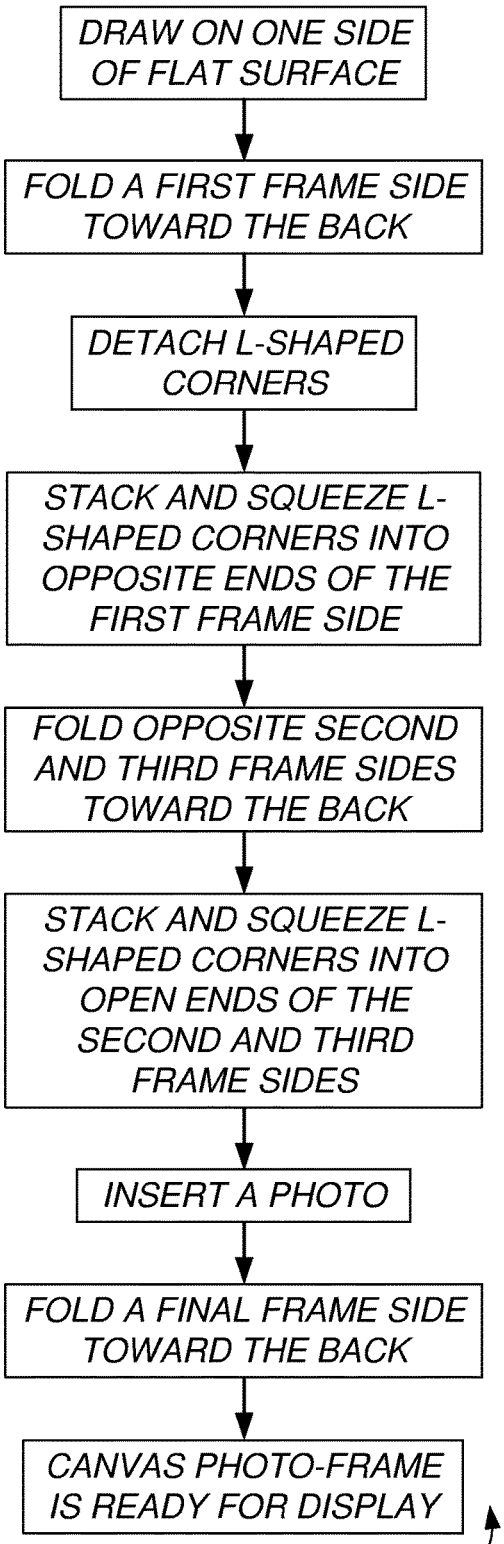
FIG. 12 is a flow chart showing steps to form a paperboard canvas photo frame having L-shaped corner reinforcements.

With further reference to FIG. 12, a method 50 for producing the alternative configuration 10" of FIGS. 7-9 as a canvas photo frame includes the steps of FIG. 11, but drawing on just one side, then inserting a photo before folding the final frame side.

Figure 13:
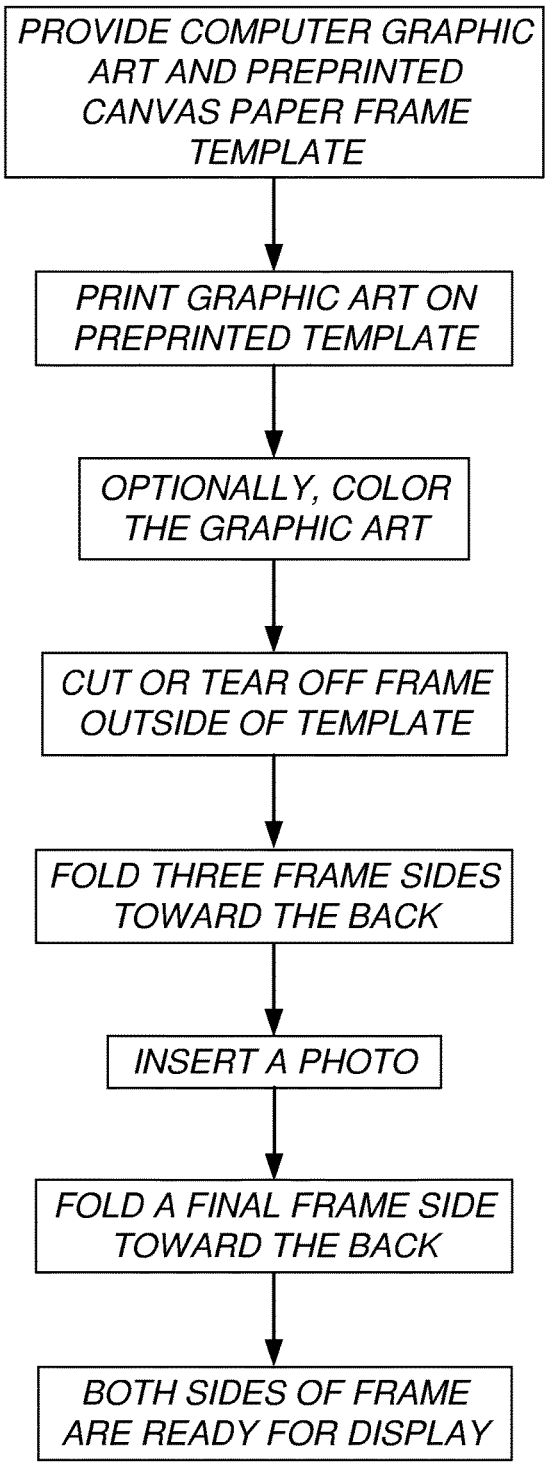
FIG. 13 is a flow chart showing steps to form a canvas print drawing frame/photo frame.

With further reference to FIG. 13, a method 60 for producing a canvas print photo frame includes the steps of:

1. Providing computer graphic art and the frame template preprinted on printer-compatible stock;
2. Printing the graphic art on the template;
3. Optionally coloring the graphic art;
4. Cutting or tearing off stock outside of template;
5. Folding three frame sides toward the back;
6. Inserting a photo;
7. Folding the final frame side toward the back; and
8. Whereby both sides of the frame are ready for display.

Figure 15:
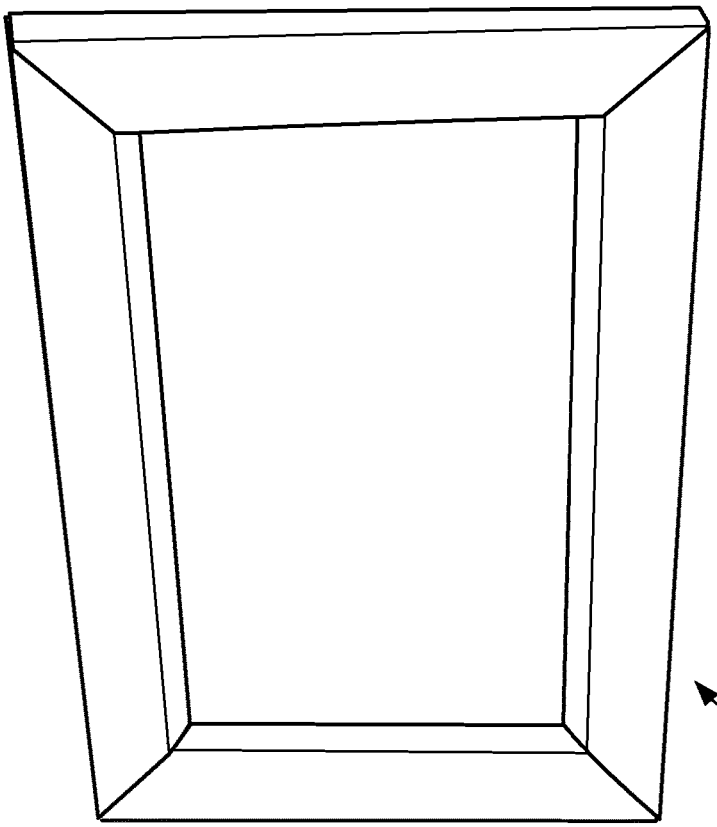
FIG. 15 is a perspective view showing the craft media in a closed condition.
Figure 14:
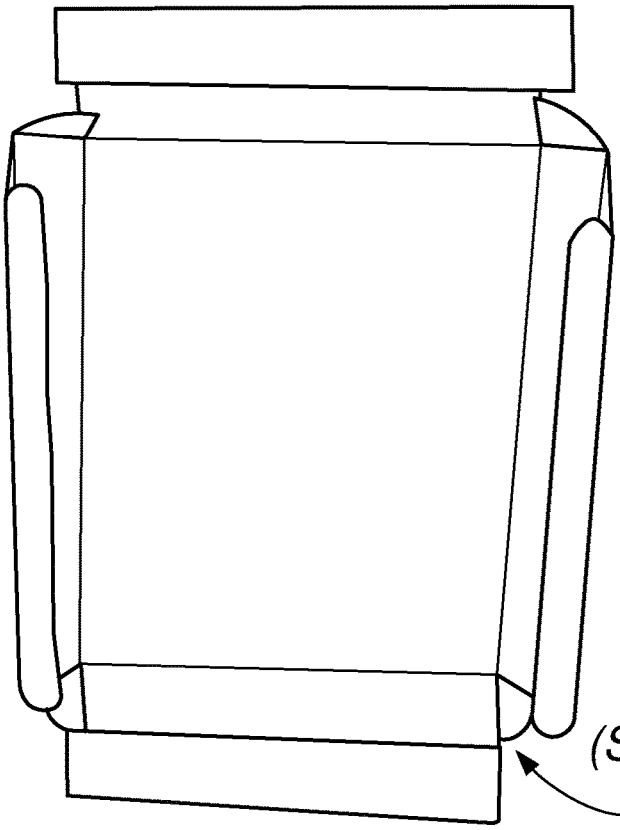
FIG. 14 is a perspective view showing the craft media of FIGS. 1-4 in an open condition.
Figure 16:
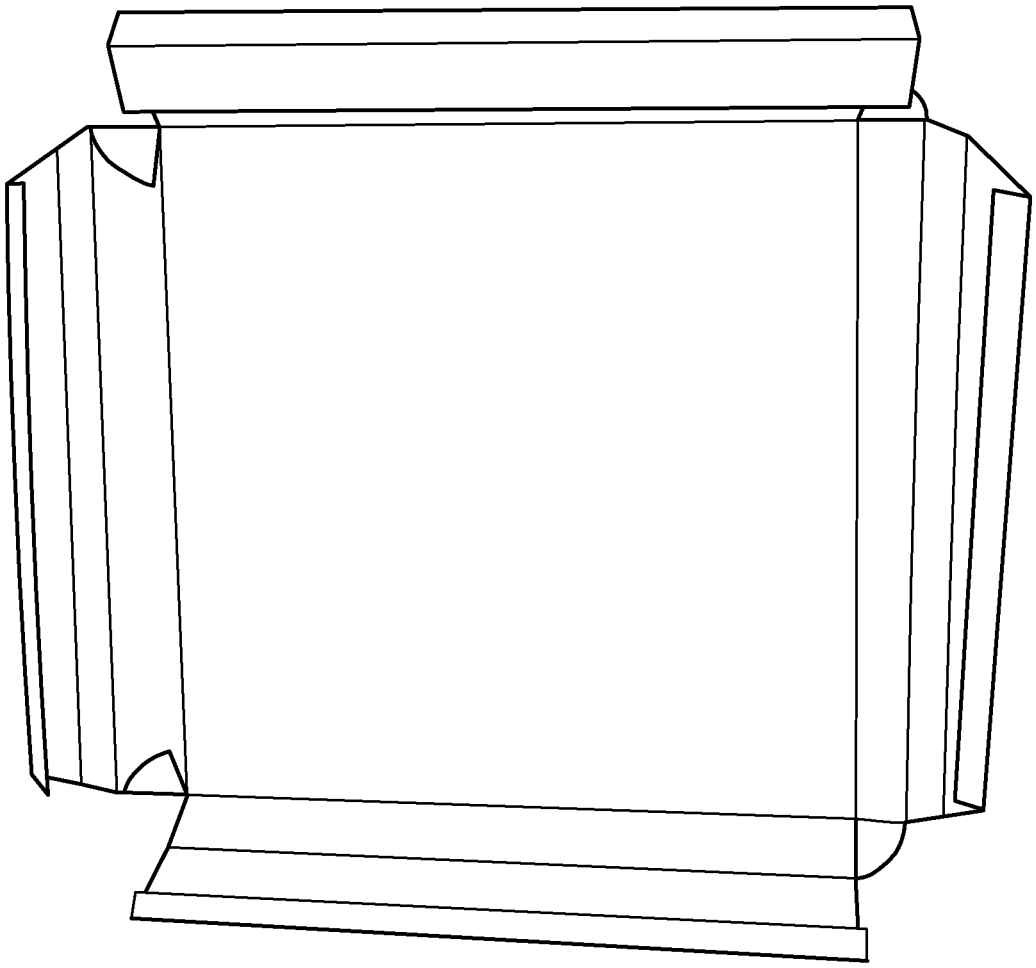
FIG. 16 is a perspective view showing the craft media of FIGS. 5 and 6 in an open condition.
Figure 17:
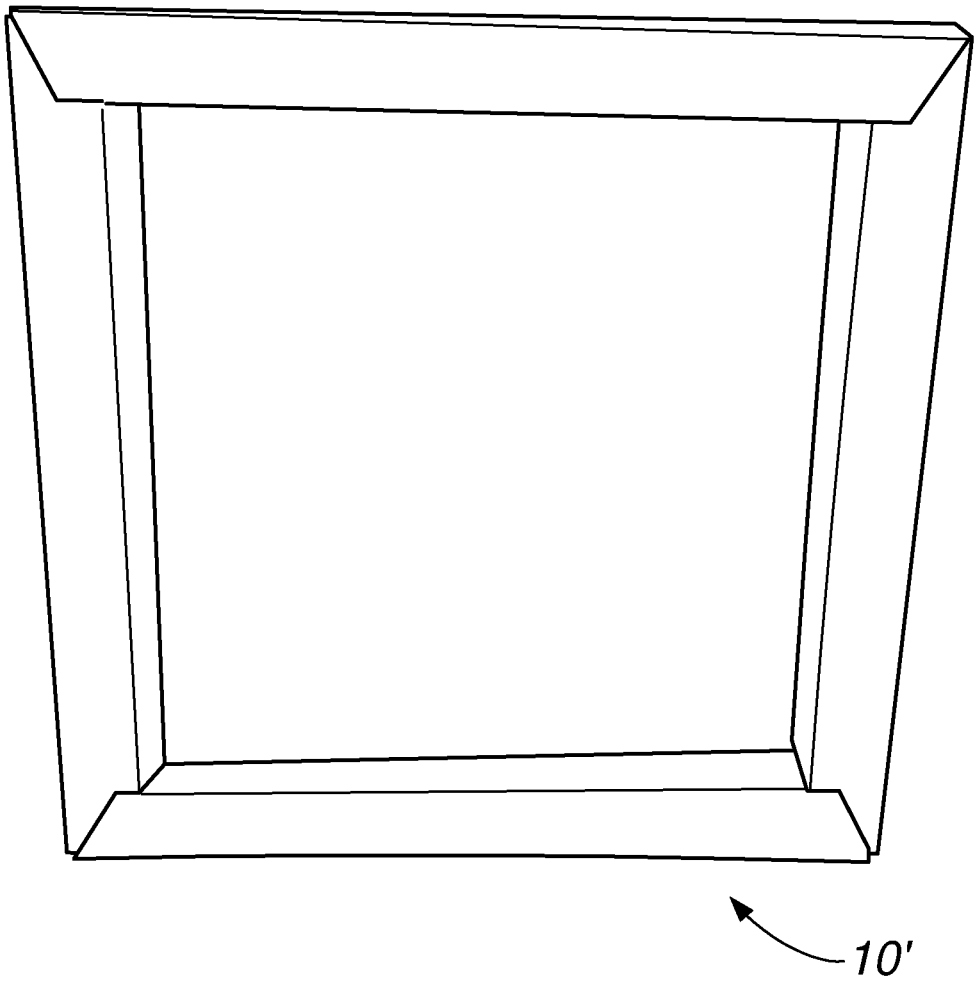
FIG. 17 is a perspective view showing the craft media in a closed condition.
Figure 18:
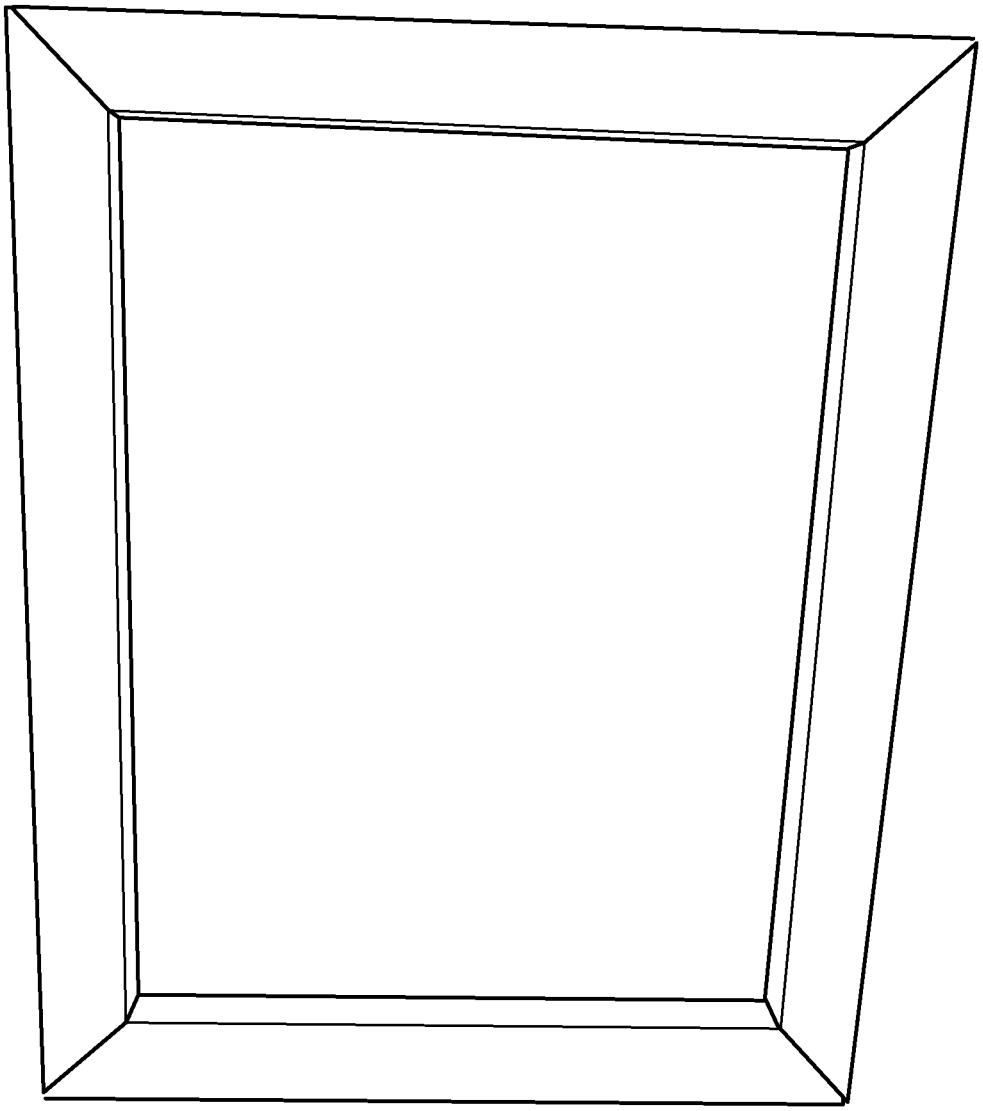
FIG. 18 is a perspective view showing the craft media of FIGS. 7-9 in a closed condition.

With further reference to FIGS. 14-18, samples of the present invention have been constructed as described above. FIG. 14 is a perspective view showing the craft media 10 of FIGS. 1-4 in an open condition; FIG. 15 is a perspective view showing the craft media 10 in a closed condition; FIG. 16 is a perspective view showing the craft media 10' of FIGS. 5 and 6 in an open condition; FIG. 17 is a perspective view showing the craft media 10' in a closed condition; and FIG. 18 is a perspective view showing the craft media 10" of FIGS. 7-9 in a closed condition.

Optionally, a magnet can be used to stand the completed craft media on metal, or patch to a metal board or metal screw cover, and/or to connect plural instances of the craft media. Further, adhesive patches can be inserted between the tabs 22 and the main media portion 12.

As described above, a sheet of 2D paper cardboard (any thickness) can be folded into a 3D rectangular frame with or without using such structural supports as the L-Shaped corner members (either 2 or 4 pieces) or an inner rectangular frame. Any type of papers can be used, including inkjet photo paper, laser printing paper, canvas paper, watercolor paper, sketch paper, cardboard, canvas with paper backing, etc. The pattern outline and slits (as well as embossing for the folds) can be pre-formed in stamping operations that leave full sheets intact for printing. The paper can be 3D canvas board with backing (very thick paper board), 3D canvas art (medium thickness paper) and DIY (do it yourself) inkjet paper photo frame (very thin paper). Any size of papers (A1, A2, A3, A4, Letter, legal, B, C, etc.) can also be used. Further, any type of writing and drawing apparatus can be used on the surfaces, and both sides of the surfaces can be drawn and/or printed on. Moreover, any type of wall mounting methods (tape, magnetic strips, etc.) can be used, or even a desk stand without wall mounting. Also, as an alternative to the separate L-shaped corner members described above, open rectangular supports, either unitary (possibly hollow) or in layers, can reinforce all four corners of the frame.

Although the present invention has been described in considerable detail with reference to certain preferred versions, other versions are possible. Therefore, the spirit and scope of the appended claims should not necessarily be limited to the description of preferred versions contained herein.

What is claimed is:

1. Craft pictorial media, comprising:

(a) a sheet of foldable media material having means for defining a generally rectangular perimeter outline and locations of folds to be made, for producing a reinforcing frame integrally with the media, the fold locations being on lines spaced inwardly from sides and ends of the perimeter outline, for defining respective inside edges, back edges, and outside edges of a combined main media portion and frame portion; and (b) L-shaped corner reinforcement members to be enclosed within corner portions of the frame portion.

2. The craft pictorial media of claim 1, further comprising an additional fold location between that for the inside edge and the perimeter outline for defining a tab to be tucked against the main media portion of the media between the inside edge and the outside edge.

3. The craft pictorial media of claim 1, wherein the fold locations are embossed therein for facilitating clean (straight and accurately located) folding.

4. The craft pictorial media of claim 3, wherein the fold locations are drawn, such as by printing.

5. The craft pictorial media of claim 1, wherein the fold locations are drawn, such as by printing.

6. The craft pictorial media of claim 1, further comprising means for defining one or more intersecting slit pairs suitable for receiving a hanger member such as a nail head.

7. The craft pictorial media of claim 6, wherein the one or more intersecting slit pairs are located on a back edge portion of the media, for use when artwork is to be applied opposite the frame portion.

8. The craft pictorial media of claim 7, further comprising an additional slit pair located symmetrically on an opposite one of the back edge portions.

9. The craft pictorial media of claim 6, wherein the one or more intersecting slit pairs are located on a main portion of the media between the inside edge and the outside edge, for use when artwork is to be applied within an area defined by the inside edges of the frame.

10. The craft pictorial media of claim 1, wherein the reinforcement members have a thickness that closely fits between the main portion and the back edge.

11. The craft pictorial media of claim 1, wherein the reinforcement members are formed of a suitable plastic.

12. Craft pictorial media, comprising:

(a) a sheet of foldable media material having means for defining a generally rectangular perimeter outline and locations of folds to be made, for producing a reinforcing frame integrally with the media, the fold locations being on lines spaced inwardly from sides and ends of the perimeter outline, for defining respective inside edges, back edges, and outside edges of a combined main media portion and frame portion; and (b) L-shaped corner reinforcement members to be enclosed within corner portions of the frame portion, wherein the reinforcement members have a thickness that closely fits between the main portion and the back edge, wherein the reinforcement members are formed of a stacked plurality of the media material.

* * * * *